US007448612B2

(12) United States Patent
Rumford et al.

(10) Patent No.: US 7,448,612 B2
(45) Date of Patent: Nov. 11, 2008

(54) AUTO-COMPENSATING MECHANISM LIFTER

(75) Inventors: Robert W. Rumford, Lexington, KY (US); Gregory P. Washnock, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 540 days.

(21) Appl. No.: 10/879,873

(22) Filed: Jun. 28, 2004

(65) Prior Publication Data

US 2005/0285328 A1 Dec. 29, 2005

(51) Int. Cl.
*B65H 3/06* (2006.01)

(52) U.S. Cl. ..... 271/118; 271/116

(58) Field of Classification Search ..... 271/117, 271/118, 119

See application file for complete search history.

(56) References Cited

U.S. PATENT DOCUMENTS

| | | | | |
|---|---|---|---|---|
| 5,527,026 | A | 6/1996 | Padget et al. | |
| 5,868,385 | A | 2/1999 | Embry et al. | |
| 5,895,040 | A | 4/1999 | Oleska et al. | |
| 5,909,872 | A | 6/1999 | Takahashi | |
| 5,918,874 | A | 7/1999 | Armstron et al. | |
| 5,932,313 | A | 8/1999 | Barton | |
| 5,954,327 | A | 9/1999 | Lin et al. | |
| 5,971,390 | A | 10/1999 | Caspar et al. | |
| 6,305,682 | B1 | 10/2001 | Saito et al. | |
| 6,390,463 | B1 * | 5/2002 | Iwago | 271/118 |
| 6,616,136 | B1 * | 9/2003 | Huang et al. | 271/10.13 |
| 6,857,630 | B2 * | 2/2005 | Yu | 271/116 |
| 6,991,227 | B2 * | 1/2006 | Kim | 271/10.12 |
| 2004/0070136 | A1 | 4/2004 | Chung | |
| 2005/0023745 | A1 * | 2/2005 | Morimoto et al. | 271/117 |

FOREIGN PATENT DOCUMENTS

JP 2001220026 A * 8/2001

OTHER PUBLICATIONS

U.S. Appl. No. 10/865,632, Cook et al.

* cited by examiner

*Primary Examiner*—Kaitlin S Joerger
(74) *Attorney, Agent, or Firm*—Middleton Reutlinger

(57) ABSTRACT

An auto-compensating mechanism lifter comprises an auto-compensating mechanism (ACM) and a lifter for moving a sheet of print media from a media feed tray in a document feeding device for printer, multifunction device or similar device. The auto-compensating mechanism includes a housing having a pick tire and drive train therein. The housing is pivotally mounted for movement in a first direction and a second direction. The pick tire is mounted to the housing and operably engaging the drive train and the print media. The auto-compensating lifter comprises a spring clutch coupling a drive shaft and the housing for rotating the ACM onto or away from the print media in the media feed tray depending upon the direction of rotation of the drive shaft. The pick roller is mounted distal to the pivotal connection of the auto-compensating mechanism to the drive shaft.

27 Claims, 9 Drawing Sheets

AUTO-COMPENSATING MECHANISM LIFTER

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTINGS, ETC.

None.

BACKGROUND

1. Field of the Invention

The present invention provides an auto-compensating mechanism (ACM). More specifically, the present invention provides an auto-compensating mechanism having a spring clutch coupling the auto-compensating mechanism housing and a drive shaft and which transfers reverse pick motor torque from the drive shaft to the ACM to rotate the auto-compensating mechanism housing and pick tire away from engagement with a media stack.

2. Description of the Related Art

It has been previously suggested to utilize a tray or bin in order to support a stack of sheets of print media in which the upper most sheet of the stack may be advanced to a processing station or printing area for printing by a laser printer or inkjet printer, for example. In typical printing or duplicating devices, individual sheets of print media are advanced to the processing station by utilizing a paper picking device.

With paper picking devices a critical relationship exists between the pick roller and the media stack. More specifically the relationship involves a normal force between the pick roller and the paper stack. When too much normal force exists, multi-feeds may occur resulting in paper jams. When too little normal force exists, paper will not feed into the printing area. Current devices utilize either a spring loaded paper stack or spring loaded pick roll in order to provide the normal force for picking. Despite extensive tuning of this normal force, usually only a very narrow range of media will run reliably on these devices. In other words, these systems are critically effected by various media characteristics including, but not limited to, density, net weight, stiffness and smoothness of the media surface. Feeding of print media sheets from a stack has been significantly improved by an auto-compensating mechanism (ACM) shown and described in U.S. Pat. No. 5,527,026, issued to Padget et al., which is incorporated by reference herein.

Auto-compensating paper feeders address prior art issues in paper feeding. In an auto-compensating paper feed mechanism or swing-arm designs, the pick roller or tire and media stack are not spring loaded against one another. Instead the pick roll is mounted on the rotating swing arm and the pick roll rests on the media stack. When the pick roll drive is initiated through a gear located on the pivot shaft with the swing arm, a torque is applied to the swing-arm through a gear transmission which rotates the swing arm and pick roll into the paper stack. This generates a normal force which is dictated by the buckling resistance of the media being picked. The normal force is no more than is required to buckle a single sheet of media plus the friction resistance between the first and second sheets. When the upper most sheet has moved, the normal force automatically relaxes and, thus, the auto-compensating mechanism delivers the normal force that what is required to feed a single sheet of media.

According to one design of an auto-compensating mechanism, the ACM may utilize a clutch to allow the tire or pick roller to rotate freely once the print media is indexed in a paper feed direction through, for example, the print area. Although the tire maintains contact with the media and friction is reduced between the pick roller and upper most media sheet, this design still introduces drag on the media which may result in skewing and print defects.

Given the foregoing deficiencies, it will be appreciated that an apparatus is needed which inhibits contact between the auto-compensating mechanism and media stack as a media sheet is advanced by at least one feed roller.

SUMMARY OF THE INVENTION

The present invention comprises an auto-compensating mechanism including a spring clutch to couple a drive shaft and the auto-compensating mechanism housing. A pick motor is provided for driving the drive shaft in forward and reverse directions and when the pick motor is reversed the spring clutch which couples the drive shaft to the auto-compensating mechanism housing moves the arm away from a print media stack.

More specifically, the auto-compensating mechanism lifter comprises an auto-compensating mechanism, or swing-arm, and a lifter. The auto-compensating mechanism includes a housing having a pick tire or roller and drive train therein. The housing is pivotally mounted for movement in a first direction and a second direction about a drive shaft. The pick tire is mounted to the housing and operably engaging the drive train. The auto-compensating lifter comprises a spring clutch coupling the drive shaft and the housing. The pick tire is mounted distal to the pivotal connection of the swing-arm. The apparatus further comprises at least one motor for driving the drive shaft in a first direction, for instance a pick direction, and a second direction, for instance a reverse and lift direction. When the at least one motor is reversed, it causes lifting of the pick tire from the media stack. The spring clutch transfers rotation of the drive shaft relative to the drive train in a reverse direction to the auto-compensating mechanism housing. The drive shaft has a milled portion utilized for engagement between the drive shaft and at least one gear of the auto-compensating mechanism drive train. Alternatively, the drive shaft may have a pin aperture and a pin extending through the pin aperture for torque transfer wherein the pin engages at least one gear of the drive train. The spring clutch may be a wrap spring clutch allowing application of torque to the housing in one direction so that the ACM is lifted away from the media and overrides on the ACM housing (i.e., rotates or spins with minimal torque transfer due to friction) such that torque is applied to the pick roll drive train in a second direction. Alternatively, the spring clutch may be a compression spring clutch. According to this embodiment a stop may be disposed a preselected distance from the auto-compensating mechanism housing such that the compression spring clutch is compressed between the housing and the stop.

DETAILED DESCRIPTION

Referring now in detail to the drawings, wherein like numerals indicate like elements throughout the several views, there are shown in FIGS. 1-10 various aspects of an auto-compensating mechanism lifter. The auto-compensating mechanism lifter functions to pick an uppermost sheet of media from a media stack disposed in an input tray and move the print media to feed rollers for advancement through a printing or image forming apparatus, or through an auto-document feeder for a scan apparatus. Once the print media engages the feed rolls, a print controller signals a pick motor to reverse in order to lift the auto-compensating mechanism from the media stack. Lifting of the auto-compensating mechanism inhibits friction between the pick tire and media sheet and further inhibits media sheet skewing as the media enters the print zone.

Figure 1:
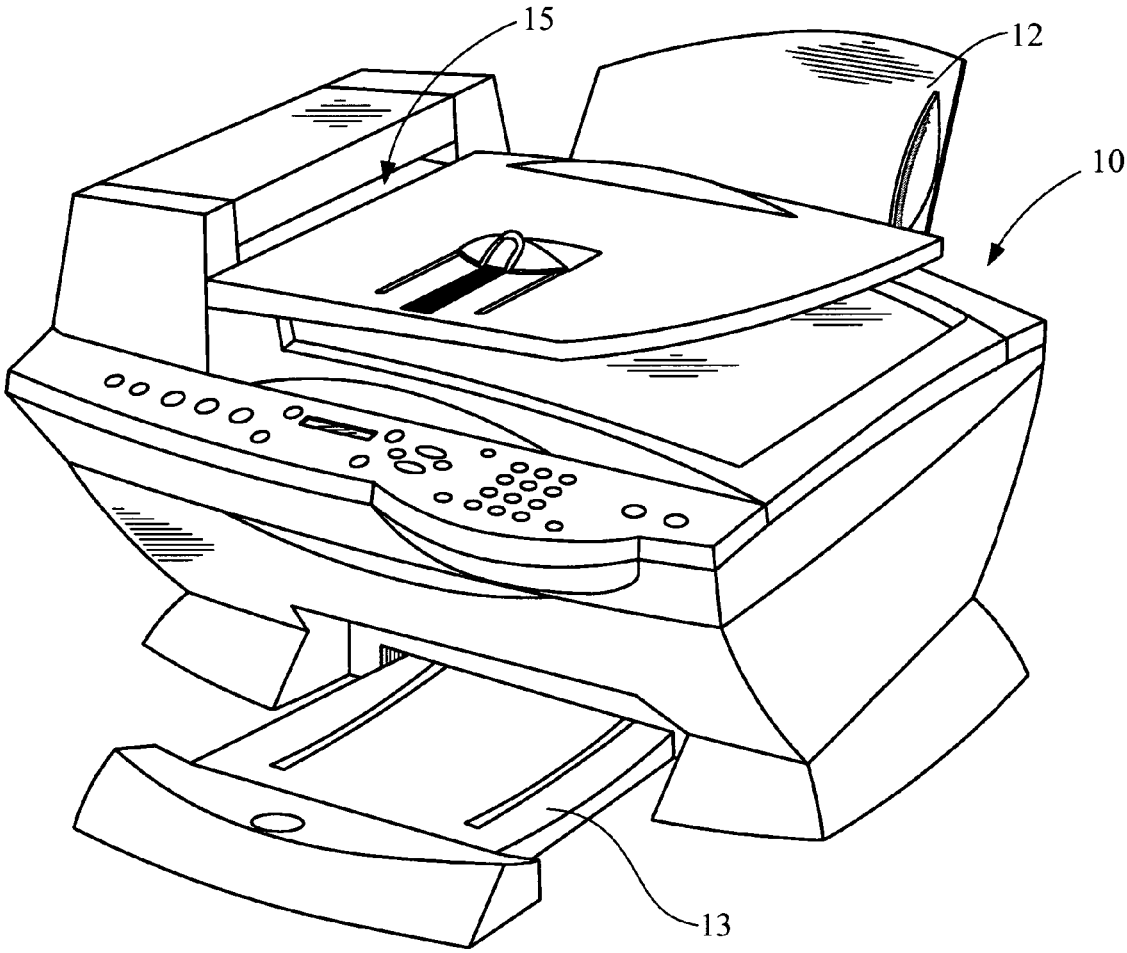
FIG. 1 is a perspective view of an illustrative image forming apparatus utilizing the auto-compensating mechanism lifter of the-present invention.

Referring initially to FIG. 1, an image forming apparatus 10 is shown for use with the auto-compensating mechanism lifter of the present invention. For purposes of this invention description, the invention will be described with respect to an image forming apparatus shown and described in the Figures which may be utilized with a multi-function peripheral having a laser printer, a thermal inkjet printer or a piezo inkjet printer. However, it should be understood that it is well within the scope of the present invention that the auto-compensating mechanism lift may be used with an auto-document feeder through input 15 on a scanning device of a multi-function peripheral, a stand-alone scanner, a stand-alone printer, a stand-alone fax, copier, or the like requiring automated paper feed. As indicated in the FIG. 1, the printer or multi-function peripheral may include a media supply or input tray 12, a media exit or output tray 13 which define a media feed path extending between the input tray 12 and the output tray 13 and through a print zone. The multi-function peripheral or image forming apparatus 10 may have an input tray frame 14 for receiving a plurality of pages.

Figure 2:
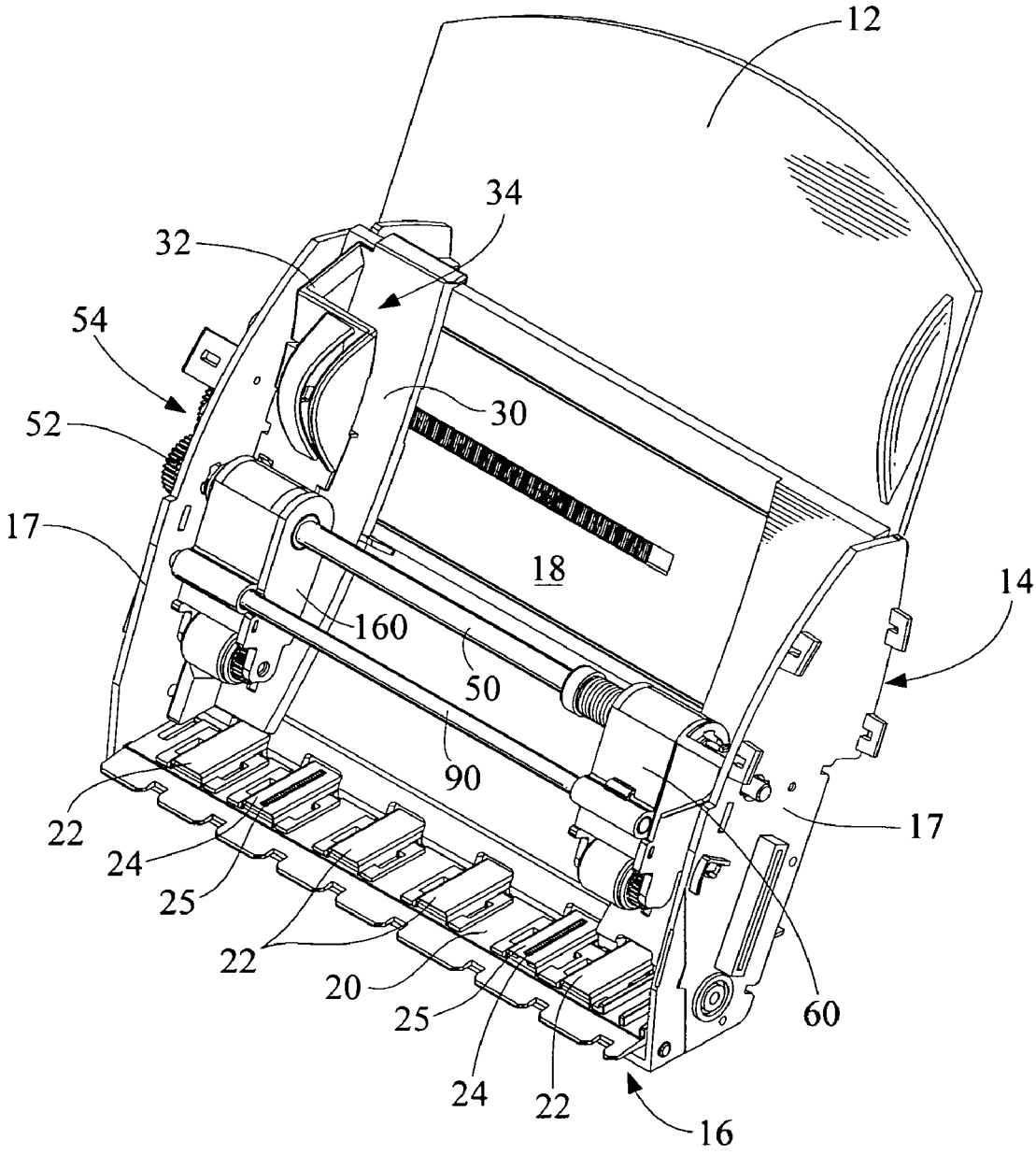
FIG. 2 is perspective view of the input tray frame having the auto-compensating mechanism and lifter.
Figure 4:
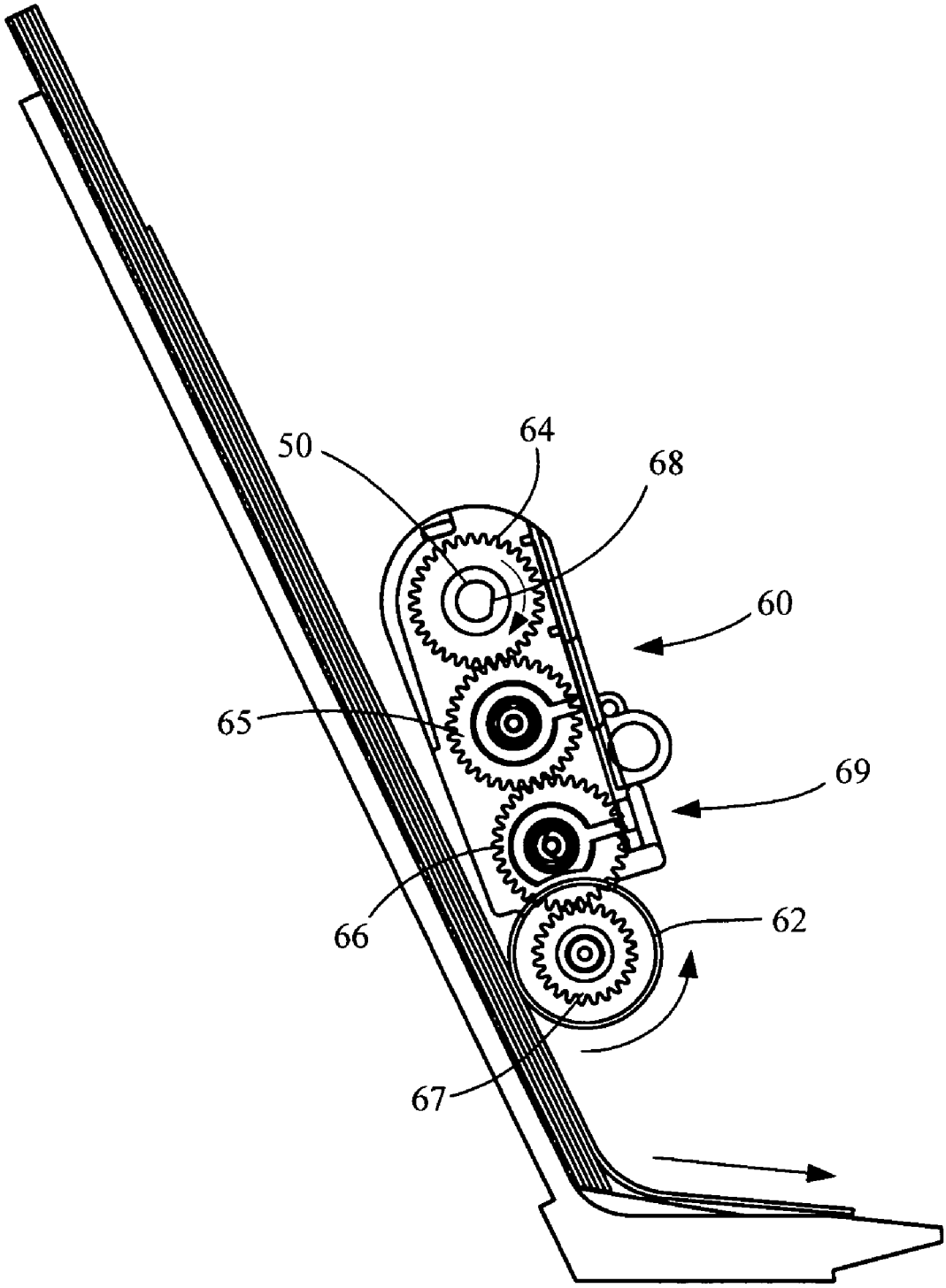
FIG. 4 is a side view of the auto-compensating mechanism and lifter of FIG. 2 engaging a media stack.
Figure 5:
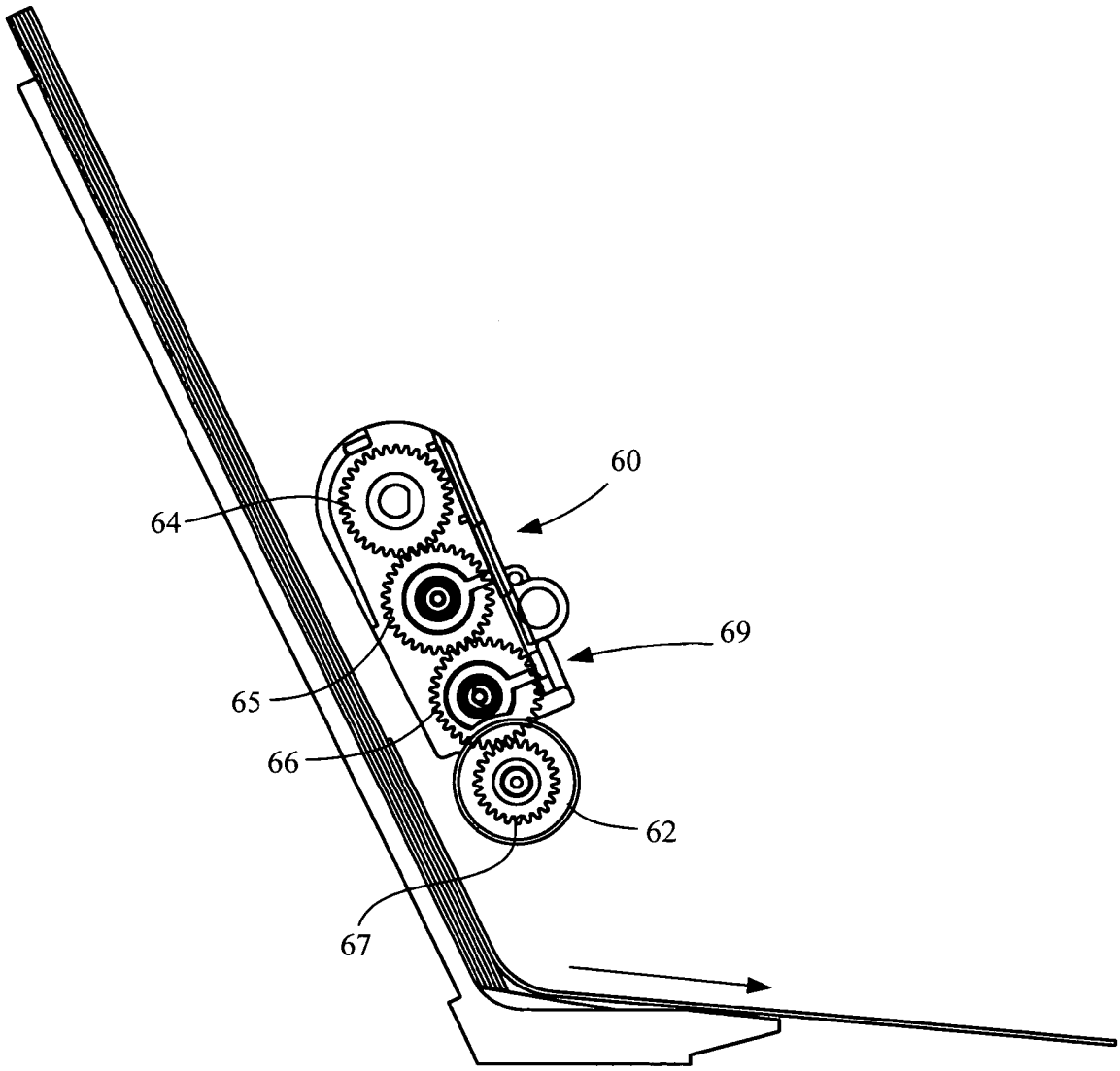
FIG. 5 is a side view of the auto-compensating mechanism and lifter of FIG. 4 in a second idle position rotated from the media stack.

Referring now to FIG. 2, a perspective view of an input tray frame 14 is shown. The input tray frame 14 comprises a substantially horizontal bottom wall 16, first and second parallel side walls 17 extending upwardly from the horizontal bottom wall 16, and an inclined rear wall 18 extending between the parallel side walls 17 and from a rear edge portion of the horizontal bottom wall 16. The inclined rear wall 18 is inclined at an angle of about 115° from the horizontal bottom wall 16, as best shown in FIG. 5, however this angle may vary depending on the characteristics of the printer being utilized. Further, the inclined rear wall 18 may be straight as shown in FIGS. 4-5 or may include a curvature as shown in FIG. 2. The parallel side walls 17 may be integral with the horizontal bottom wall 16 and inclined rear wall 18. The input tray frame 14 may be formed of various materials including, for instance, a polymeric material which may be molded at low cost to the manufacturer.

Still referring to FIG. 2, a paper edge guide 30 is shown slideably disposed along an upper edge of the inclined rear wall 18 and depending downwardly along the inclined rear wall 18. The paper edge guide 30 includes a member 32 extending from the paper guide and defining a channel 34. A plurality of print media sheets defining a media stack may be disposed within the channel 34 providing media for printing, copying or for receiving fax documents in either a printer, copier, fax, or multi-function peripheral device. The paper edge guide 30 may be slidably positioned in order to allow slidable movement thereof and adjust for print media of varying width. At a lower portion of the member 32 are auto-compensating mechanisms 60, 160.

Positioned above the horizontal bottom wall 16 is a support plate 20 having a plurality of ribs or paper dams 22 positioned along an upper surface thereof. The paper dams 22 provide positive engagement between the print media stack and the bottom of the input tray frame 14 so that a user knows when the media stack is fully inserted into the input tray frame 14 and therefore does not exert excess force which may cause multiple media feeds. The paper dams 22 may be formed of metal, for instance, when used in laser or inkjet printer applications, or formed of plastic or polymeric material, for instance, when used in lower cost inkjet applications. The paper dams 22 engage the print media disposed within the channel 34 of input frame 14 and provide friction along the leading edge, with respect to the feed path, of the print media. As further depicted in FIG. 2, bucklers 24 are also positioned along the support plate 20 and also engage the leading edge of the print media disposed within the channel 34 of the input tray frame 14. The bucklers 24 are generally formed of metal or plastic and include a slot along an upper surface wherein an insert 25 provides an increased amount of friction as compared to the parallel paper dams 22. The insert 25 disposed within the bucklers 24 may be formed of a material having a high coefficient of friction with paper such as polyurethane, for example. The inserts 25 may comprise a serrated edge in order to increase friction and thereby aid the auto-compensating mechanism 60 to separate the uppermost sheet of print media from the stack disposed within the input tray frame 14 in order to feed a single sheet of print media to the feed rollers.

Figure 3:
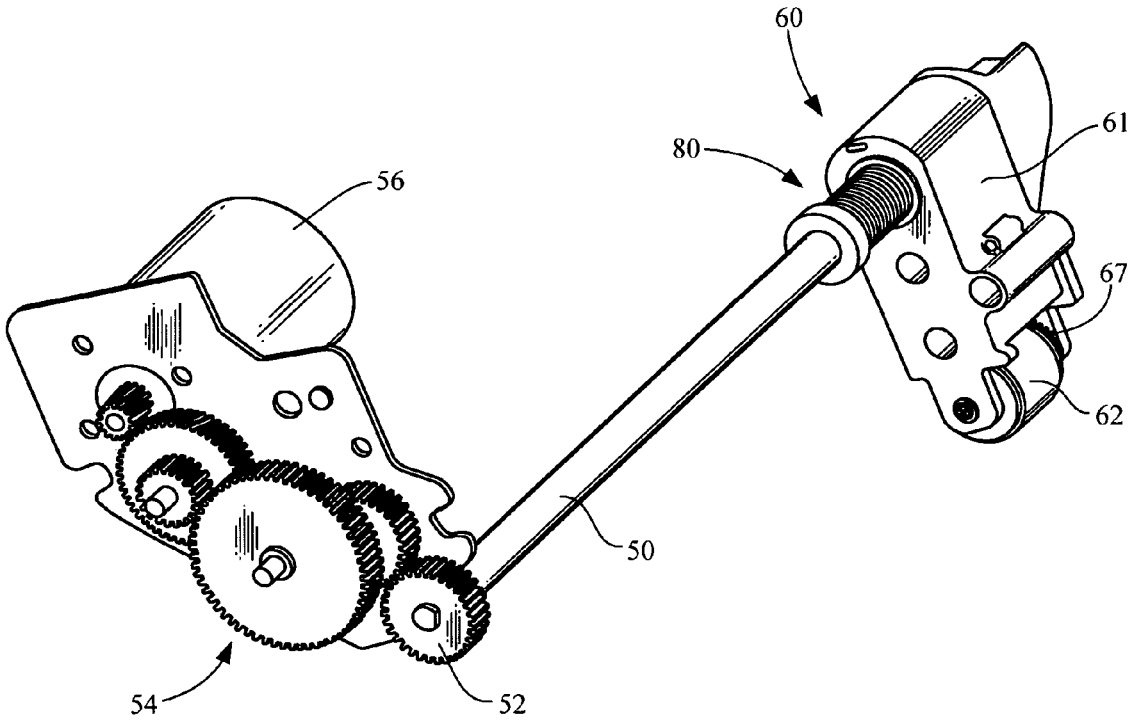
FIG. 3 is a perspective view of a pick motor and pick motor drive train utilized with the auto-compensating mechanism lifter of FIG. 2.
Figure 7:
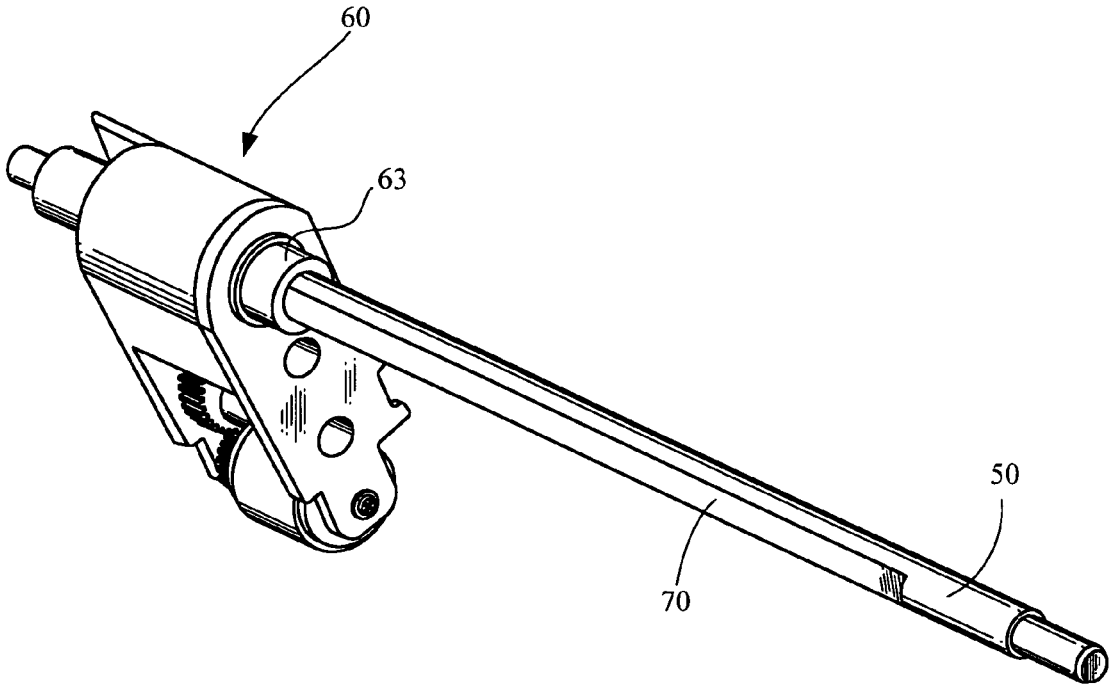
FIG. 7 is a rear perspective view of the auto-compensating mechanism of FIG. 6.

Referring now to FIGS. 2 and 3, a drive shaft 50 is shown extending between the parallel side walls 17 of the input tray frame 14. At a first end of the drive shaft 50 is a drive shaft gear 52 which engages a pick motor drive train 54. The drive train 54 operably engages a pick motor 56 having a spur, helical gear, belt or the like such that rotation of the pick motor 56 transmits rotational energy to the drive train 54 and drive shaft gear 52 thereby rotating the drive shaft 50. The drive shaft 50 is substantially cylindrical in shape and may have a milled portion 70 as shown in FIG. 7 for engagement of the auto-compensating mechanisms 60, 160. As shown in FIG. 4, at least one gear of the pick tire drive train 69, described further herein, is operably coupled to the drive shaft 50 by utilizing a gear 64 having a substantially D-shaped aperture to mateably receive the drive shaft milled portion 70.

As illustrated in FIGS. 2-6, the auto-compensating mechanism 60 comprises a housing 61 and a pick tire or roller 62 at a lower open end of the housing 61. Within the housing 61 is a pick roll drive train 69 defined by a plurality of gears 64, 65, 66, 67 which causes rotation of the pick tire 62. The first gear 64 comprises a substantially circular aperture having at least one flat wall portion 68 for engaging the milled portion of the drive shaft 50 extending through the housing 61. In other words the aperture maybe substantially D-shaped. Engagement between the milled portion 70 (FIG. 7) and the flat wall of the first gear 64 allows torque transfer from the drive shaft 50 to the drive train 69. Operably engaging the first gear 64 are second and third gears 65, 66 which operably engage a fourth gear 67 thereby turning the pick tire 62. As indicated by the arrows shown in FIG. 4, the drive shaft 50 is rotated in a clockwise direction in order to turn the pick tire 62 in a counter-clockwise direction and pick print media from the input tray frame 14. As previously indicated, when the pick roll drive train 69 is initiated by the drive shaft 50, a torque is applied to the swing arm or auto-compensating mechanism 60 through the downstream gears in the pick roll drive train 69 which rotates the auto-compensating mechanism 60 and pick tire 62 onto the media stack. A normal force between the pick tire 62 and the print media stack in the media tray frame 14 is dictated by the buckling resistance of the media being picked. The normal force generated is what is required to buckle a single sheet of media plus the frictional resistance between the uppermost sheet and the next adjacent sheet. Thus, when the required buckling force of the media is greater than the frictional resistance of the first and second sheet, multi-feeding of the print media will not occur. Once the uppermost sheet has buckled, the normal force automatically seeks equilibrium dictated by the frictional drag between the first and second sheet. In other words, the auto-compensating mechanism does not deliver more normal force than what is required to feed a single sheet of media.

As shown in FIG. 4, the swing-arm 60 moves toward the media stack with clockwise rotation of the drive shaft 50. As a result the pick roller 62 rotates against the media stack feeding out the uppermost sheet of the media stack until the sheet engages the feed rollers, not shown. In FIG. 5, the print controller has signaled the pick motor to reverse direction. As a result, a wrap spring clutch couples the drive shaft 50 to the auto-compensating mechanism housing 61 causing the auto-compensating mechanism 60 to rotate away from the media stack and thus rotating the pick tire 62 away from the media stack. This inhibits friction between the uppermost print media and the pick roller from skewing the print media as the feed rollers, not shown, pull the media into the printing area. Thus, by moving the auto-compensating mechanism 60 away from the print media, media skewing and print defects are decreased.

Figure 6:
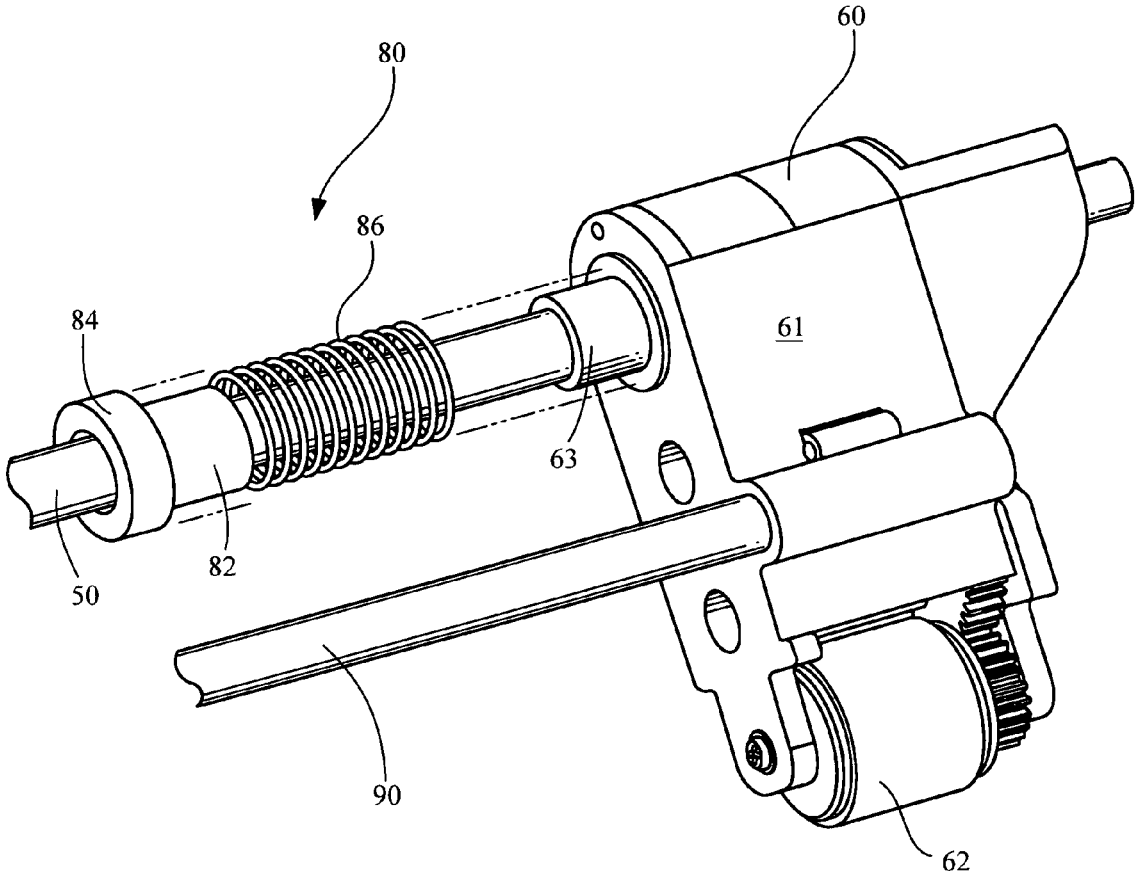
FIG. 6 is a perspective view of the auto-compensating lifter of FIG. 2.

Referring now to FIGS. 6 and 7, in order to effect movement of the auto-compensating mechanism 60 away from the stack of print media, a spring clutch 80 is utilized. The wrap spring clutch 80 functions by spinning freely adjacent the housing 61 so that the torque is applied to the pick roll drive train 69 in the picking direction. Alternatively, the spring clutch 80 applies torque to the housing 61 when the pick motor 56 (FIG. 3) is reversed in the non-pick direction. The spring clutch 80 comprises a wrap spring 86, a retaining portion or holder defined by a flange 84 and a neck 82 mounted on the drive shaft 50. The neck 82 abuts a side post 63 having a opening therethrough for receiving an end of drive shaft 50. The side post 63 extends from, and attached to, the auto-compensating mechanism housing 61 with the wrap spring 86 positioned therebetween on the drive shift 50. The flange 84 and neck 82 have a drive shaft aperture extending therethrough through which the drive shaft 50 extends into the auto-compensating mechanism 60 through side post 63. According to the illustrative embodiment the drive shaft aperture can be D-shaped to receive the milled or D-shaped portion 70 of the drive shaft 50 (FIG. 7). The spring clutch 80 couples the rotation of drive shaft 50 to the side post 63 of the auto-compensating mechanism housing 61. Thus, torque from the drive shaft 50 is transferred to the ACM housing 61 so that the auto-compensating mechanism 60 rotates away from a media stack. However, in a second opposite direction, the spring clutch 80 only slightly engages the side post 63 so that the rotation of the drive shaft 50 is transferred to the gear train 69 in the ACM 60 to pick the media. In order to produce this frictional engagement, the wrap spring 86 extends along the neck 82 from the flange 84 to the auto-compensating mechanism 60 and further wrapping over the side post 63. The wrap spring 86 frictionally couples the drive shaft 50 and side post 63 when the drive shaft 50 is turned in one direction, in this illustrative embodiment counter-clockwise. In order to maintain the abutting engagement between the spring clutch 80 and the side post 63, an E-clip, set screw (not shown) or the like may be utilized to hold the spring clutch 80 in position on the drive shaft 50 and relative to the side post 63.

As the wrap spring 86 extends about the outer circumference of the neck 82, there is an interference between the inner diameter of the wrap spring 86 and both the outer diameter of the neck 82 and the side post 63 so that the side post 63 is coupled to the drive shaft 50 and the neck 82. The neck 82 and side post 63 are sized so that the neck 82 has a slightly larger outer diameter than the side post 63. Thus the spring 86 has a greater interference fit with the neck 82 than the side post 63. When the drive shaft 50 is rotated in a counter-clockwise direction the wrap spring clutch 80 transfers torque in the direction that the spring 86 wraps downward about the neck 82 and side post 63, which is the direction of spring 86 winding. For example, according to the instant embodiment, when the drive shaft 50 rotates in a counter-clockwise direction, the same direction as the spring 86 is wound, the spring 86 will tighten against the neck 82 and side post 63 so that the auto-compensating mechanism 60 is coupled to and rotating with the drive shaft 50. In other words when the drive shaft 50 rotates in the counter-clockwise direction, the drive shaft 50 is frictionally engaged to the side post 63 and auto-compensating mechanism housing 61. Thus the auto-compensating mechanism 60 is rotated away from the media stack with minimal rotation of the ACM drive train 69. Alternatively when the drive shaft 50 rotates in a clockwise direction, the wrap spring 86 does not tighten on the neck 82 and side post 63 thus allowing rotation of the drive shaft relative to the gear train 69. In this scenario, a pick tire 62 may be driven to pick an upper most media sheet from the media stack.

Referring back to FIGS. 2 and 6, an auto-compensating mechanism lift bar 90 is shown extending between the first auto-compensating mechanism 60 and the second auto-compensating mechanism 160. The second auto-compensating mechanism 160 is utilized to advance the print media in combination with auto-compensating mechanism 60 to the feed roller so that the print media is not skewed, which is more likely when only a single ACM is used. The auto-compensating mechanism lift bar 90 connects the first auto-compensating mechanism 60 and the second auto-compensating mechanism, raising the second auto-compensating mechanism 160 when the spring wrap clutch 80 lifts the first auto-compensating mechanism 60. In other words, when the auto-compensating mechanism 60 begins lifting due to reversal of the pick motor 56, the auto-compensating mechanism lift bar 90 forces the second auto-compensating mechanism 160 to lift as well. This results in no friction transfer from the pick tires 62 of the two ACMs to the media sheets within the input tray frame 14.

Figure 8:
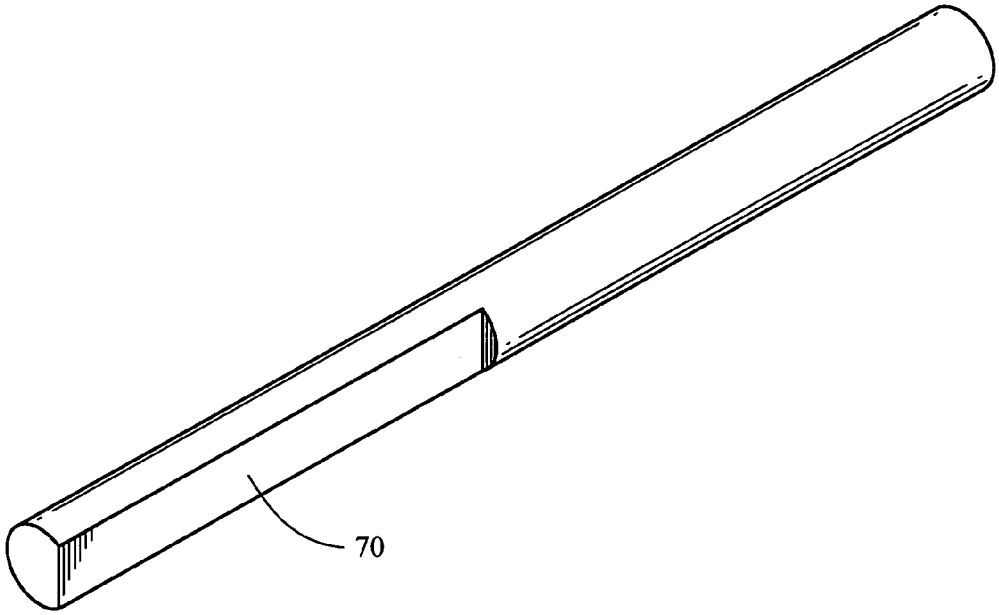
FIG. 8 is a perspective view of one exemplary drive shaft of the present invention.
Figure 9:
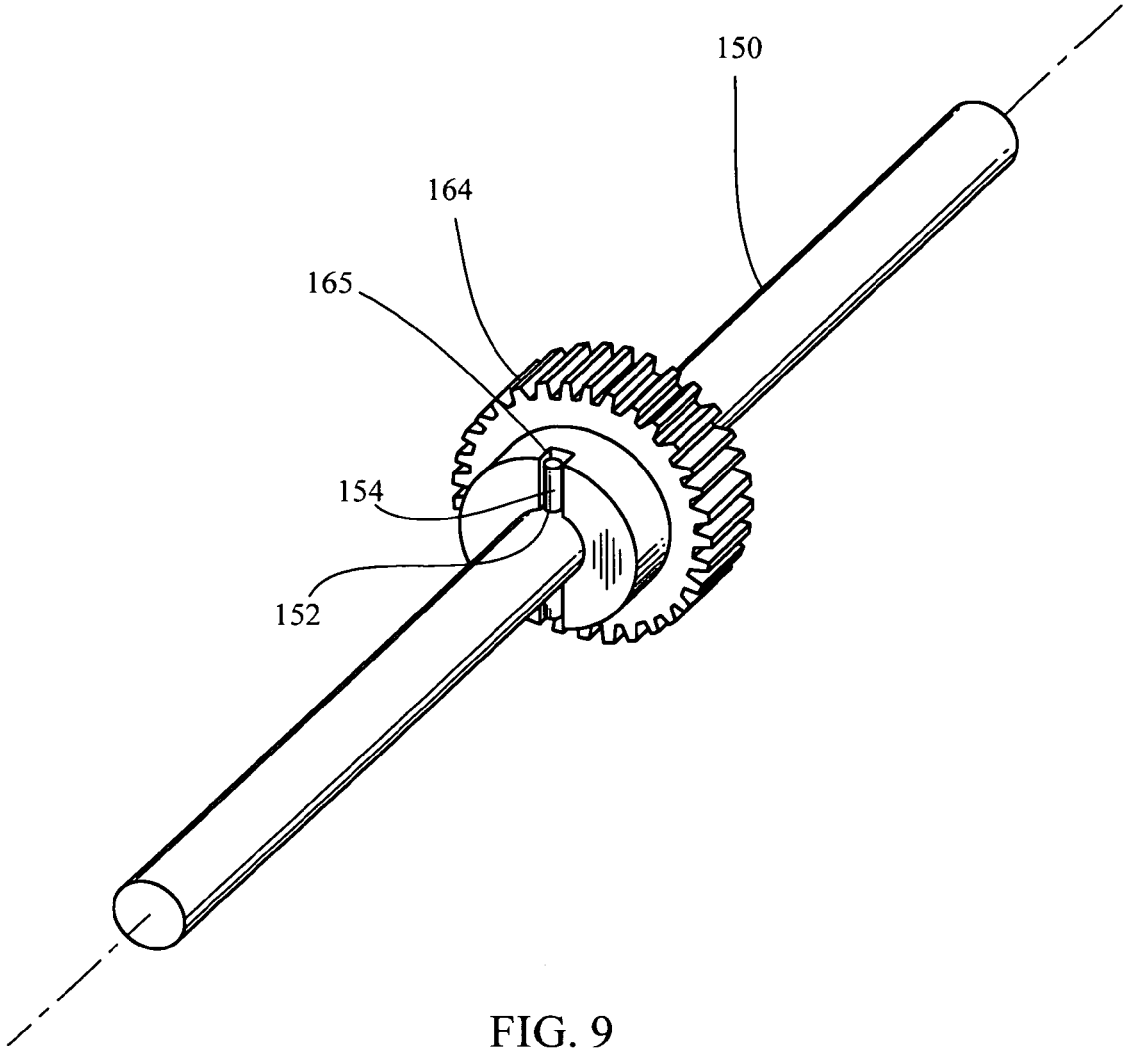
FIG. 9 is a perspective view of an alternative drive shaft of the present invention.

Referring now to FIGS. 7 and 8, as previously indicated the drive shaft 50 may include a milled portion 70 which defines a D-shaped shaft 50. The milled portion 70 engages a flat wall in an aperture of the first gear 64 (FIG. 4). Engagement of the flat wall of the first gear aperture and the milled portion causes transfer torque from the drive shaft 50 to the auto-compensating mechanism 60 to rotate the pick tire 62. According to a second embodiment depicted in FIG. 9, an alternative drive shaft 150 may be utilized to transmit torque from the pick motor 56 to the auto-compensating mechanism 60. The drive shaft 150 may include a pin aperture 152 extending through the shaft 150 substantially perpendicular to the shaft axis 150, shown in broken line. A pin 154 is positioned to extend through the pin aperture 152 and may be adhered therein with a fixative. Alternatively, the pin 154 may be frictionally fit, press fit utilizing an interference engagement, or may threadably engage the pin aperture 152. In yet a further alternative, clips or flanges may be utilized to hold the pin 154 within the pin aperture 152. With the pin 154 extending through the shaft 150, a first gear 164 may be positioned on the drive shaft 150 to engage the pin 154 by having a slot 165 (shown for purposes of illustration as being U-shaped) in its face which engages the pin 154. This configuration allows torque transfer from the drive shaft 150 to the drive train 69 or the auto-compensating mechanism housing 61 for lifting of the auto-compensating mechanism from a stack of media. Similarly, with an additional pin 154 extending through the shaft 150, the flange 82 may be positioned on the drive shaft 150 to engage the pin.

Figure 10:
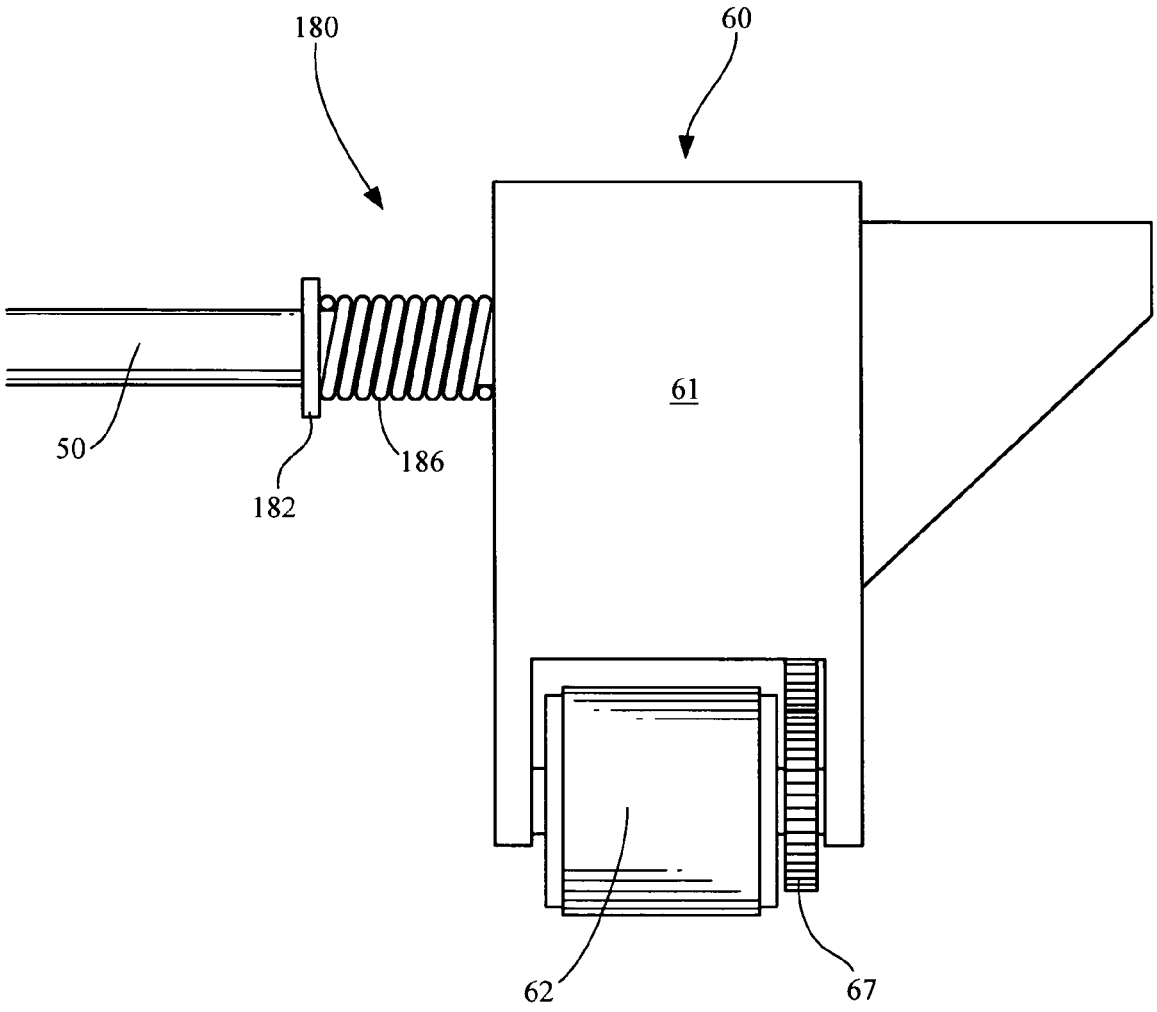
FIG. 10 is a top view of an alternative embodiment comprising a compression spring engaging the auto-compensating mechanism for lifting the device.

Referring now to FIG. 10, according to yet a further alternative embodiment, a compression spring clutch 180 may be utilized with the ACM 60 of the present invention. The compression spring clutch 180 comprises a compression spring 186 disposed on the shaft 50. The spring 186 is compressed between a stop 182 (also disposed on the shaft 50) and the housing 61. The stop 182 may be, for example, an E-clip or other fastener mounted to the shaft 50 in a fixed position relative to said the housing 61. Since the stop 182 is in a fixed position, there is a preselected distance between the stop 182 and the swing-arm 60. This distance should be less than the relaxed length of the compression spring 186 so that the spring 186 must be compressed for positioning between the stop 182 and the housing 61. According to this alternative embodiment, the torque on the drive shaft 50 is applied to the housing 61 in both the pick and non-pick directions so that the ACM 60 is rotated toward the media stack in a first pick direction or away from the media in a second non-pick direction.

It should be understood that various alternative structures are contemplated herein and are generally deemed to be within the scope of the present invention. For example the present auto-compensating mechanism lifter embodiments may be utilized with a multi-function peripheral or stand alone printer or any such paper feeding apparatus.

We claim:

1. An auto-compensating mechanism lifter assembly, comprising:

a reversible motor operable in one of a first direction and a second direction;

an auto-compensating mechanism comprising:

a housing including a drive train therein, said housing pivotally mounted for movement in a first direction and a second direction about a drive shaft;

a pick tire mounted on said housing and operably engaged by said drive train;

an auto-compensating mechanism lifter, wherein:

in one of said first direction and said second direction of said reversible motor, a spring clutch is positioned on said drive shaft and engages said drive shaft and said housing and further wherein said auto-compensating mechanism moves to a first position and said pick tire disengages media during media feeding;

in the other of said first direction and said second direction of said reversible motor, said spring clutch disengages said drive shaft and said housing and further wherein said auto-compensating mechanism moves to a second position and said pick tire engages said media during said media feeding;

and further wherein said reversible motor drives both said pick tire of said auto-compensating mechanism and said auto-compensating mechanism lifter.

2. The auto-compensating mechanism lifter assembly of claim 1 wherein said pick tire is mounted distal to said pivotal connection of said housing.

3. The auto-compensating mechanism lifter assembly of claim 1 wherein in one direction the rotation causes movement of said pick roller to pick media from a media tray.

4. The auto-compensating mechanism lifter assembly of claim 3 wherein reversing the direction of said at least one motor causes movement of said pick roller away from said media stack.

5. The auto-compensating mechanism lifter assembly of claim 1 wherein said reversible motor is a pick motor.

6. The auto-compensating mechanism lifter assembly of claim 5 wherein reversal of said pick motor causes lifting of said pick roller and said housing from a print media stack.

7. The auto-compensating mechanism lifter assembly of claim 1 wherein said spring clutch inhibits rotation of said drive shaft relative to said media stack.

8. The auto-compensating mechanism lifter assembly of claim 1 further comprising said drive shaft having a milled portion.

9. The auto-compensating mechanism lifter assembly of claim 8 further comprising said milled portion being utilized for engagement between said drive shaft and at least one gear of said drive train.

10. The auto-compensating mechanism lifter assembly of claim 9 further comprising said milled portion being utilized for engagement between said drive shaft and a spring clutch holder.

11. The auto-compensating mechanism lifter assembly of claim 1 further comprising said drive shaft having a pin aperture and a pin extending through said pin aperture.

12. The auto-compensating mechanism lifter assembly of claim 11 further comprising said pin engaging at least one gear of said drive train.

13. The auto-compensating mechanism lifter assembly of claim 11, further comprising a spring clutch holder having a flange with said pin engaging said flange.

14. The auto-compensating mechanism lifter assembly of claim 1 further comprising a wrap spring clutch.

15. The auto-compensating mechanism lifter assembly of claim 14, said wrap spring clutch allowing application of torque to said housing in a first direction and application of torque to said pick roll drive train in a second direction.

16. The auto-compensating mechanism lifter assembly of claim 1, further comprising a compression spring clutch.

17. The auto-compensating mechanism lifter assembly of claim 16 further comprising a stop disposed a preselected distance from said auto-compensating mechanism housing, said compression spring clutch compressed between said housing and said stop.

18. A print or scan media feed apparatus with lifter and support tray, comprising:

a reversible motor operable in a first direction and a second direction;

a media support tray for holding a media stack;

an auto-compensating mechanism having a pick roller at an end distal to a pivotal connection, said auto-compensating mechanism including a gear transmission operably engaging said pick roller;

a spring clutch disengaging said auto-compensating mechanism and allowing pick roller rotation onto said media stack during media feeding;

said spring clutch engaging said auto-compensating mechanism and lifting said auto-compensating mechanism from said media stack during media feeding;

in one of said first and second directions of said reversible motor, said auto-compensating mechanism being movable in a first position during media feeding wherein said pick roller disengages media and in the other of said first and second directions of said reversible motor, said auto-compensating mechanism being movable in a second position during media feeding wherein said pick roller engages said media stack;

wherein said reversible motor causes rotation of said pick roller and movement of said pick roller between said first position and said second position.

19. The print media feed apparatus with lifter and support tray of claim 18 further comprising a drive shaft operably connecting said reversible motor and said auto-compensating mechanism.

20. The print media feed apparatus with lifter and support tray of claim 19 wherein said gear transmission comprises a pick roll drive train and said drive shaft having a milled portion of a length sufficient to mount at least one gear of said pick roll drive train with said at least one gear having an aperture having a surface for engaging said milled portion of said drive shaft.

21. The print media feed apparatus with lifter and support tray of claim 18 wherein said drive shaft farther comprises a pin aperture therethrough for receiving a pin extending through said drive shaft.

22. The print media feed apparatus with lifter and support tray of claim 21 wherein said gear transmission comprises a pick roll drive train with said pin engaging at least one gear of said pick roll drive train mounted on said drive shaft.

23. The print media feed apparatus with lifter and support tray of claim 21 further comprising said spring clutch holder engaging with said pin.

24. The print media feed apparatus with lifter and support tray of claim 18 further comprising said spring clutch being a wrap spring clutch coupling said drive shaft and said auto-compensating mechanism housing.

25. The print media feed apparatus with lifter and support tray of claim 24 further comprising said wrap spring clutch applying a torque for lifting to said auto-compensating mechanism housing.

26. The print media feed apparatus with lifter and support tray of claim 18 further comprising said spring clutch being a compression spring disposed between said auto-compensating mechanism and a stop.

27. The print media feed apparatus with lifter and support tray of claim 26 further comprising said compression spring applying a torque for lifting to said auto-compensating mechanism housing.

* * * * *